US007844210B2

(12) United States Patent
Sawahata et al.

(10) Patent No.: US 7,844,210 B2
(45) Date of Patent: Nov. 30, 2010

(54) FIXING APPARATUS AND IMAGE FORMING APPARATUS USING IT

(75) Inventors: Sho Sawahata, Ibaraki (JP); Yuji Ohmura, Ibaraki (JP); Yoshikuni Sasaki, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 545 days.

(21) Appl. No.: 11/905,359

(22) Filed: Sep. 28, 2007

(65) Prior Publication Data

US 2008/0080912 A1 Apr. 3, 2008

(30) Foreign Application Priority Data

Sep. 29, 2006 (JP) ..... P2006-268122
Mar. 8, 2007 (JP) ..... P2007-058114

(51) Int. Cl.
*G03G 15/20* (2006.01)

(52) U.S. Cl. ..... 399/333

(58) Field of Classification Search ..... 399/331, 399/332, 333, 328; 430/124.1, 124.3, 124.32, 430/124.33
See application file for complete search history.

(56) References Cited

U.S. PATENT DOCUMENTS 4,829,931 A * 5/1989 Mogi ..... 118/60
5,939,337 A * 8/1999 Hatakeyama et al. ..... 442/6
5,940,655 A * 8/1999 Sano et al. ..... 399/69
5,974,295 A * 10/1999 De Niel et al. ..... 399/333
2001/0022909 A1 * 9/2001 Takeuchi et al. ..... 399/328
2002/0090237 A1 7/2002 Tanaka et al.
2003/0063916 A1 4/2003 Katayanagi et al.
2005/0048296 A1 3/2005 Meguriya et al.
2007/0173595 A1 * 7/2007 Tsuji et al. ..... 524/588

FOREIGN PATENT DOCUMENTS

JP 2006-18075 1/2006

OTHER PUBLICATIONS

German Office Action dated Oct. 30, 2008 with English-Language Translation.

* cited by examiner

*Primary Examiner*—David P Porta
*Assistant Examiner*—Kiho Kim
(74) *Attorney, Agent, or Firm*—McGinn Intellectual Property Law Group, PLLC

(57) ABSTRACT

According to an aspect of the present invention, there is provided a fixing apparatus including: a heat roller that includes: a heat source that generates heat to be supplied on a toner image formed on a recording medium; a cylindrical core; a rubber layer that is formed on the cylindrical core and includes a thermal-conductivity-enhanced rubber, the rubber layer having a thickness of Tg that satisfies 200 μm≦Tg≦600 μm and having a rubber hardness defined by JIS-A hardness of Hg that satisfies 40 degrees≦Hg≦80 degrees; and a fluororesin layer that is formed on the rubber layer, the fluororesin layer having a thickness of Tj that satisfies 80 μm≦Tj≦300 μm and 2 Tj≦Tg≦10 Tj; and a pressure roller that presses the recording medium against the heat roller.

13 Claims, 2 Drawing Sheets

FIXING APPARATUS AND IMAGE FORMING APPARATUS USING IT

CROSS-REFERENCE TO RELATED APPLICATIONS

This application is based upon and claims a priority from prior Japanese Patent Application No. 2006-268122 filed on Sep. 29, 2006 and from prior Japanese Patent Application No. 2007-058114 filed on Mar. 8, 2007, the entire contents of which are incorporated herein by reference.

BACKGROUND OF THE INVENTION

1. Field of the Invention

An aspect of the present invention relates to a fixing apparatus that fixes, on a recording medium, a toner image that has been transferred to the recording medium by an electrophotographic method, as well as to an image forming apparatus using it.

2. Description of the Related Art

The fixing roller of the fixing apparatus that fixes a toner image on a recording medium is generally classified into a roller having an outermost layer made of silicone rubber and a roller having an outermost layer made of fluororesin (PFA (tetrafluoroethylene-perfluoroalkylvinylether copolymer), PTFE (polytetrafluoroethylene), FEP (tetrafluoroethylene-hexafluoropropylene copolymer), or the like).

In the former roller, the rubber layer comes into contact with a toner image that has been transferred to a recording medium and heating is performed while the rubber layer is deformed elastically following the asperity of the toner image. Therefore, the toner image is not pressed excessively. As such, the former roller is considered advantageous over the latter roller in terms of improvement of image quality. On the other hand, the former roller has drawbacks that it is inferior to the latter roller in durability, heat resistance, and oil resistance.

For low-speed printers which performs printings of tens pages per minute and medium-speed printers which performs printings of about 100 pages per minute, a fixing roller in which a fluororesin layer is formed on a silicone rubber layer and which thus has the advantages of both kinds of rollers has been put in practical use (JP-A-2006-18075).

However, the above-described fixing roller in which the fluororesin layer is formed on the silicone rubber layer is not suitable for practical use in high-speed or ultrahigh-speed printers which performs printings of more than 200 pages per minute because the fluororesin layer on the silicone rubber layer is worn early. Furthermore, fixing rollers used in low-speed and middle-speed printers are so small in diameter as to provide a sufficient nip width of a heat roller and a pressure roller and hence cannot be used as they are in high-speed or ultrahigh-speed printers.

SUMMARY OF THE INVENTION

According to an aspect of the present invention, there is provided a fixing apparatus including: a heat roller that includes: a heat source that generates heat to be supplied on a toner image formed on a recording medium; a cylindrical core; a rubber layer that is formed on the cylindrical core and includes a thermal-conductivity-enhanced rubber, the rubber layer having a thickness of Tg that satisfies 200 μm≦Tg≦600 μm and having a rubber hardness defined by JIS-A hardness of Hg that satisfies 40 degrees≦Hg≦80 degrees; and a fluororesin layer that is formed on the rubber layer, the fluororesin layer having a thickness of Tj that satisfies 80 μm≦Tj≦300 μm and 2Tj≦Tg≦10 Tj; and a pressure roller that presses the recording medium against the heat roller.

The rubber layer may have a thermal conductivity in a range of from 0.6 W/m·K to 1.5 W/m·K and a thermal conductivity variation of within 0.1 W/m·K.

The cylindrical core may be formed in a hollow cylindrical shape. The heat source may be disposed in a hollow space of the cylindrical core.

The cylindrical core may have a thickness in a range of 4 mm to 8 mm.

The cylindrical core may have a thickness in a range of 5 mm to 7 mm.

The thickness of the rubber layer Tg may further satisfy 300 μm≦Tg≦500 μm.

The pressure roller may have an outer diameter of 70 mm or more. The pressure roller may include: a second cylindrical core; a second rubber layer that is formed on the second cylindrical core, the second rubber layer having a thickness in a range of 4 mm to 8 mm; and a second fluororesin layer that is formed on the second rubber layer, the second fluororesin layer having a thickness in a range of 80 μm to 300 μm.

The thermal-conductivity-enhanced rubber may be made of a silicone rubber and a thermal conductivity enhancer. A ratio of parts by weight of the thermal conductivity enhancer to the silicone rubber may be in a range of 1 to 5.

The thermal conductivity enhancer may be made of alumina fine powder, silica, or metal silicon.

According to another aspect of the present invention, there is provided an image forming apparatus including: an image forming unit that forms a toner image on a recording medium; and a fixing unit that fixes the toner image on the recording medium conveyed thereto, the fixing unit including: a heat roller that includes: a heat source that generates heat to be supplied on the toner image formed on the recording medium; a cylindrical core; a rubber layer that is formed on the cylindrical core and includes a thermal-conductivity-enhanced rubber, the rubber layer having a thickness of Tg that satisfies 200 μm≦Tg≦600 μm and having a rubber hardness defined by JIS-A hardness of Hg that satisfies 40 degrees≦Hg≦80 degrees; and a fluororesin layer that is formed on the rubber layer, the fluororesin layer having a thickness of Tj that satisfies 80 μm≦Tj≦300 μm and 2 Tj≦Tg≦10 Tj; and a pressure roller that presses the recording medium against the heat roller.

According to the aspects of the present invention, there are provided a fixing device capable of securing desired fixing strength and high image quality even under severe conditions of high-speed fixing, as well as an image forming apparatus using it.

BRIEF DESCRIPTION OF THE DRAWINGS

Embodiments of the present invention will be described in detail based on the following figures, wherein.

DETAILED DESCRIPTION OF THE INVENTION

An embodiment of the present invention will be hereinafter described with reference the drawings.

First, the entire configuration of an electrophotographic laser beam printer to which the embodiment is applied will be described with reference to FIG. 1.

Figure 1:
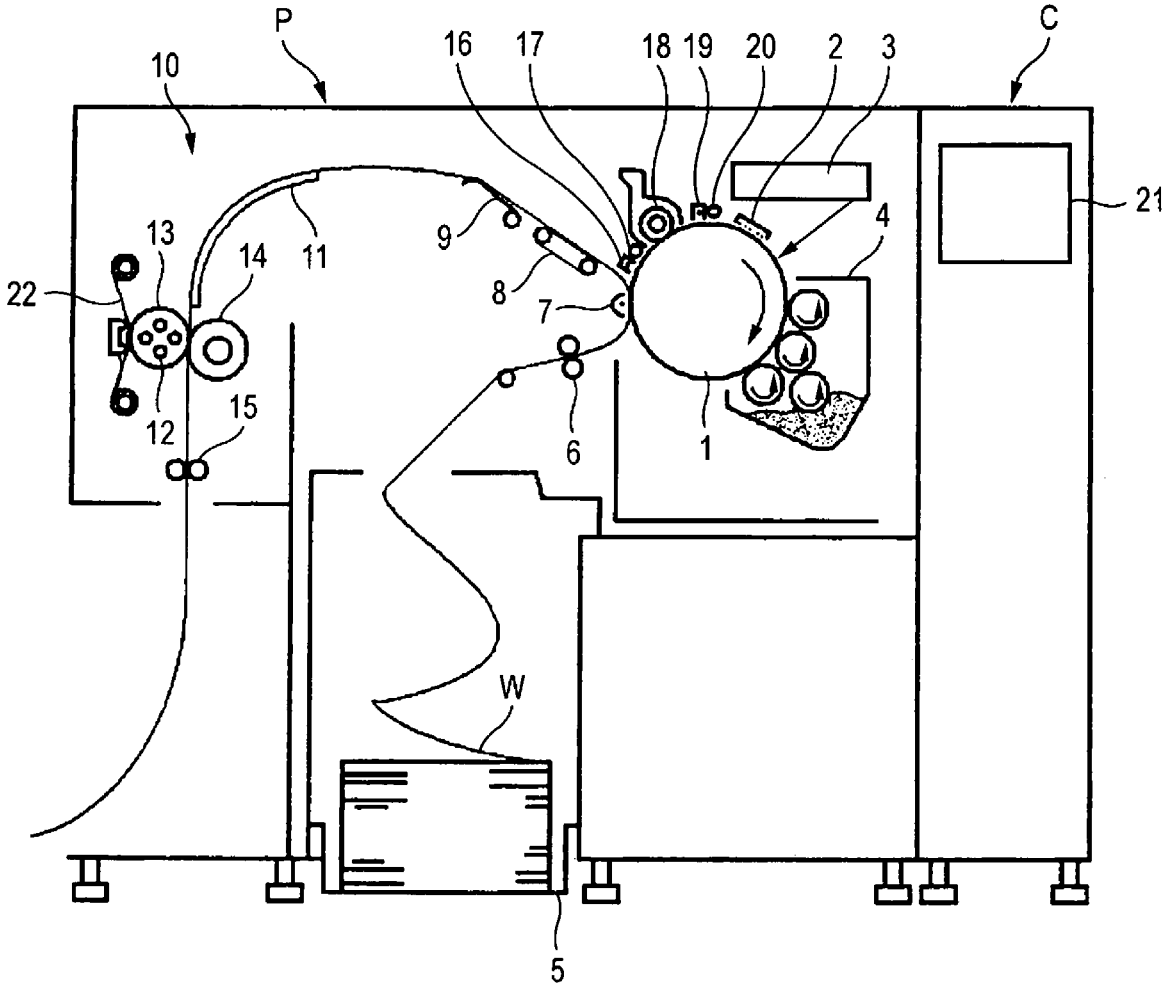
FIG. 1 shows the entire configuration of a laser beam printer using a fixing apparatus according to the embodiment.

As shown in FIG. 1, a photosensitive drum 1 of a laser beam printer P is rotated in the arrow direction on the basis of a print operation start signal from a controller C. The photosensitive drum 1 continues to rotate at a speed corresponding to a print speed of the printer P until the print operation is finished. Upon the start of rotation of the photosensitive drum 1, a high voltage is applied to a corona charger 2 and a surface region of the photosensitive drum 1 is charged up uniformly being given positive charge, for example.

The photosensitive region that has been charged up by the corona charger 2 is exposed to a light beam emitted from an exposing device 3, whereby an electrostatic latent image if formed on the surface of the photosensitive drum 1. When the photosensitive region bearing the electrostatic latent image reaches the position that is opposed to a developing device 4, toner is supplied to the electrostatic latent image. Toner that is charged positively, for example, is attracted by electrostatic force and reaches those surface portions of the photosensitive drum 1 which have been discharged by the irradiation with the light beam, whereby a toner image is formed on the photosensitive drum 1.

A web W that is set in a hopper 5 is transported by web transport rollers 6 so as to reach the transfer position between the photosensitive drum 1 and a transfer device 7 at the same time as the toner image formed on the photosensitive drum 1 reaches there.

The toner image formed on the photosensitive drum 1 is transferred to the web W by the action of the transfer device 7 which gives, to the back side of the web W, charge that is opposite in polarity to the charge of the toner image.

The web W set in the hopper 5 is transported to a fixing apparatus 10 via the web transport rollers 6, the transfer device 7, a web transport absorption belt 8, and a buffer plate 9. In the fixing apparatus 10, the web W is heated preliminarily from the back side by a preliminary heat plate 11 incorporating a heater (not shown) and is then held between and transported by a heat roller 13 incorporating heater lamps 12 and a pressure roller 14 while being heated and pressed at the nip portion that is formed by the heat roller 13 and the pressure roller 14. The toner image is thereby melted and fixed on the web W.

The web W that is sent out by the heat roller 13 and the pressure roller 14 is ejected from the machine by web feed rollers 15 and subjected to such processing as cutting in a post-processing apparatus (not shown).

The photosensitive region that has passed the transfer position passes a charge removing device 16, a charge removing lamp 17, a cleaning device 18, a pre-charger 19, and a charge removing lamp 20 to prepare for the next print operation. The charge removing device 16 serves to return, to the positive polarity, the surface potential polarity of portions the photosensitive region where the surface potential polarity has been changed from positive to negative by the action of the transfer device 7. The positive-polarity-restored photosensitive region is subjected to charge removal by the charge removing lamp 17 and then cleaned by the cleaning device 18.

Before being subjected to charging by the corona charger 2, the photosensitive region that has passed the cleaning device 18 is again subjected to charging by the pre-charger 19 and charge removal by the charge removing lamp 20, whereby the conditions of the surface of the photosensitive region are adjusted properly.

In FIG. 1, symbol 21 denotes an operating panel on which information relating to conditions of the printer P which is performing a print operation is displayed and through which printing conditions are set. The above-mentioned buffer plate 9 serves to absorb slack or tension that occurs in the web W when a transport speed difference occurs in the web W between the web transfer absorption belt 8 and the heat roller 13 and the pressure roller 14 functioning as the pair of fixing rollers. Symbol 22 denotes a cleaning web which is provided so as to be able to contact the surface of the heat roller 13 and to be taken up, and which serves to clean the surface of the heat roller 13 and apply a release agent to the surface of the heat roller 13.

Next, the structure of a heat roller used in the fixing apparatus according to the embodiment will be described with reference to FIG. 2.

Figure 2:
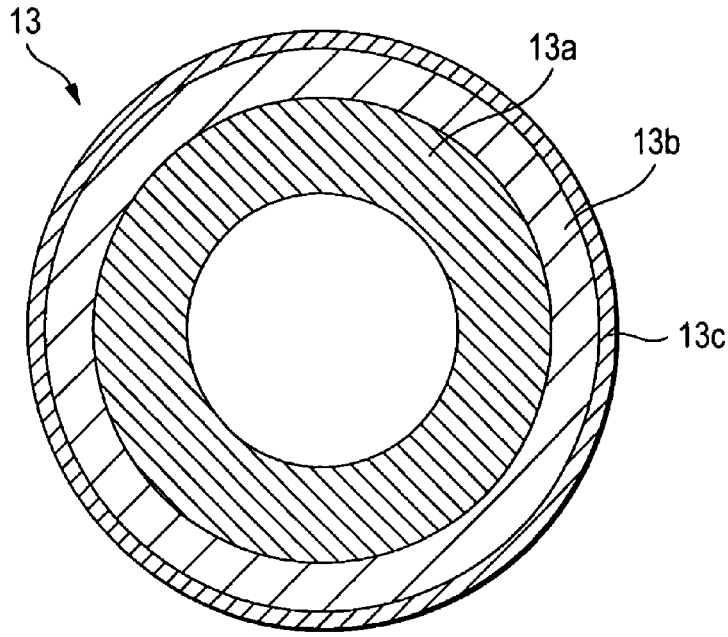
FIG. 2 is a schematic sectional view of a heat roller of the fixing apparatus according to the embodiment.

In FIG. 2, symbol 13*a* denotes a metal roller as a core member. In this embodiment, the core member 13*a* is a hollow, cylindrical aluminum roller of 4 to 8 mm in diameter.

Symbol 13*b* denotes a rubber layer provided on the core member 13*a* and symbol 13*c* denotes a fluororesin layer formed on the rubber layer 13*b*. The heat roller 13 is constructed in such a manner that the heater lamps 12 shown in FIG. 1 are inserted in the hollow space of the core member 13*a*.

The rubber layer 13*b* is formed on the core member 13*a* at a thickness of 200 to 600 μm. The rubber layer 13*b* is made of a thermal-conductivity-enhanced rubber composition which is two to four times higher in thermal conductivity than silicone rubber. This composition is obtained by adding a thermal conductivity enhancer (alumina fine powder, silica, metal silicon, or the like) of 100 to 500 parts by weight to silicone rubber of 100 parts by weight and using a catalyst such as platinum. Therefore, the ratio of parts by weight of the thermal conductivity enhancer to the silicone rubber is in a range of 1 to 5. The rubber hardness of the rubber layer 13*b* is set in a range of 40 degrees to 80 degrees (JIS A hardness) in a state that it contains the thermal conductivity enhancer.

The fluororesin layer 13*c* is formed on the rubber layer 13*b* at a thickness of 80 to 300 μm. The resin layer 13*c* is a fluororesin tube which covers the rubber layer 13*b*.

The thickness of the core member 13 is set by taking into consideration not only the thermal conductivity but also the strength (in conjunction with increase of the diameter of the heat roller 13).

To realize high-speed printing in which the print speed exceeds 200 pages/min, it is necessary to secure a sufficient total quantity, per unit area, of heat supplied to a toner image by making the fixing nip width wider than in fixing of low-speed printing.

One method for obtaining a wide fixing nip width in the roller fixing method is to use a thick rubber layer and increase the nip width by deforming the rubber layer by the pressure contact force of the fixing rollers. However, the use of this method is restricted for the purpose of high-speed fixing because the heat conduction performance lowers as the rubber layer is made thicker.

In view of the above, a wide nip width is obtained by using large-diameter of the heat roller 13 and the pressure roller 14 whose diameter may be 70 mm or more, or 100 mm or more, and thereby decreasing the curvature of the outer circumferences of the fixing rollers. The reasons why the thickness of the core member 13*a* is set in the range of 4 to 8 mm are as follows. The thickness being less than 4 mm raises a durability problem; that is, the core member 13*a* cannot endure high-speed, continuous rotations in a state that the pressure roller 14 is in pressure contact with the heat roller 13. On the other hand, the thickness exceeding 8 mm results in, for example, a problem that poor heat transmission increases the standby time to a start of printing. The thickness of the core member 13*a* is thus may be set in the range of 4 to 8 mm, or 5 to 7 mm.

The reasons why the thickness of the rubber layer 13*b* is set in the range of 200 to 600 μm are as follows. If the thickness is less than 200 μm, the rubber layer 13*b* cannot provide sufficient elastic action in a fixing nip and hence cannot secure high image quality. If the thickness exceeds 600 μm, the rubber layer 13*b* cannot transmit a sufficient quantity of heat and may cause insufficient fixing strength. Furthermore, from the viewpoint of the heat resistance of silicone rubber, it is necessary that the temperature of the interface between the core member 13*a* and the rubber layer 13*b* be kept lower than or equal to 200° C. The thickness of the rubber layer 13*b* is thus may be set in the range of 200 to 600 μm, or 300 to 500 μm.

As described above, the rubber layer 13*b* is made of the thermal-conductivity-enhanced silicone rubber composition which is made two to four times higher in thermal conductivity than silicone rubber by using the catalyst such as platinum and the rubber hardness of the rubber layer 13*b* containing the thermal conductivity enhancer is set in the range of 40 degrees to 80 degrees (JIS A hardness).

If the factor by which the thermal conductivity is increased is less than 2, the rubber layer 13*b* cannot transmit a sufficient quantity of heat and hence cannot attain desired fixing strength. If the thermal conductivity is increased by a factor that is around 5, the elastic function of the rubber layer 13*b* is lost, resulting in image quality problems.

Where the thermal conductivity enhancer is mixed, the rubber hardness necessarily becomes higher than or equal to 40 degrees (JIS A hardness). If it exceeds 80 degrees (JIS A hardness), mechanical properties such as elongation, tensile strength, and tearing strength are extremely deteriorated, resulting in production of glaring images.

The thermal conductivity of the rubber layer 13*b* containing the thermal conductivity enhancer is set in a range of 0.6 to 1.5 W/m·K. If the thermal conductivity is less than 0.6 W/m·K, the rubber layer 13*b* cannot transmit a sufficient quantity of heat and hence cannot attain desired fixing strength. If it exceeds 1.5 W/m·K, the content of the thermal conductivity enhancer in the rubber layer 13*b* is excessive, resulting in difficulty of molding.

The reasons why the thickness of the resin layer 13*c* is set in the range of 80 to 300 μm are as follows. If the thickness is less than 80 μm, the resin layer 13*c* is not given sufficient durability for use in a high-speed fixing environment in which it is rotated continuously at a high speed. If the thickness exceeds 300 μm, the elastic effect of the underlying rubber layer 13*b* is not utilized properly for the purpose of attaining necessary image quality and hence high-image-quality printing cannot be realized. From the viewpoint of durability, the resin layer 13*c* may be made of PFA.

If the thermal conductivity of the rubber layer 13*b* is increased by 1.5 W/m·K or more due to variations in manufacture, the surface control temperature of the heat roller 13 is increased by 10° C., possibly resulting in film peeling of the resin layer 13*c*. In view of this, the dispersion of the thermal conductivity enhancer in the rubber layer 13*b* is managed so that the variation of its thermal conductivity is kept within 0.1 W/m·K. For example, if a center value of the thermal conductivity of the rubber layer 13*b* is 1 W/m·K, a distribution of the thermal conductivity of the rubber layer 13*b* is in a range of (1−0.05) W/m·K to (1+0.05) W/m·K.

As for the thickness relationship between the rubber layer 13*b* and the resin layer 13*c*, the thickness of the rubber layer 13*b* is set two to ten times greater than that of the resin layer 13*c*. If the factor by which the thickness of the rubber layer 13*b* exceeds that of the resin layer 13*c* is smaller than 2, the rubber layer 13*b* cannot exercise a sufficient elastic effect and hence the image quality is lowered. If the rubber layer 13*b* is more than 10 times thicker than the resin layer 13*c*, the thermal conductivity is so low as to cause insufficient fixing strength.

According to the above discussions, performance was evaluated under the conditions that the thickness (Tg) of the thermal-conductivity-enhanced rubber layer 13*b* was in the range of 200 to 600 μm, its thermal conductivity was in the range of 0.6 to 1.5 W/m-K, the variation of its thermal conductivity was kept within 0.1 W/m·K, and the thickness (Tj) of the resin layer 13*c* was in the range of 80 to 300 μm. High-quality images were obtained without causing any problems relating to the fixing strength or the durability even when continuous printing of more than five million pages was performed by using a printer whose print speed was higher than 200 pages/min under the conditions that the relationship $2Tj \leqq Tg \leqq 10\,Tj$ was satisfied and the rubber hardness (Hg) of the thermal-conductivity-enhanced rubber layer 13*b* satisfies the relationship 40 degrees$\leqq$Hg$\leqq$80 degrees (JIS A hardness).

Although the heat roller 13 according to the above embodiment is such that the rubber layer 13*b* is made of silicone rubber and the resin layer 13*c* is a PFA tube, the heat roller 13 may be such that the rubber layer 13*b* is made of fluororubber which is high in heat resistance and the resin layer 13*c* is made of FEP or PTFE.

Figure 3:
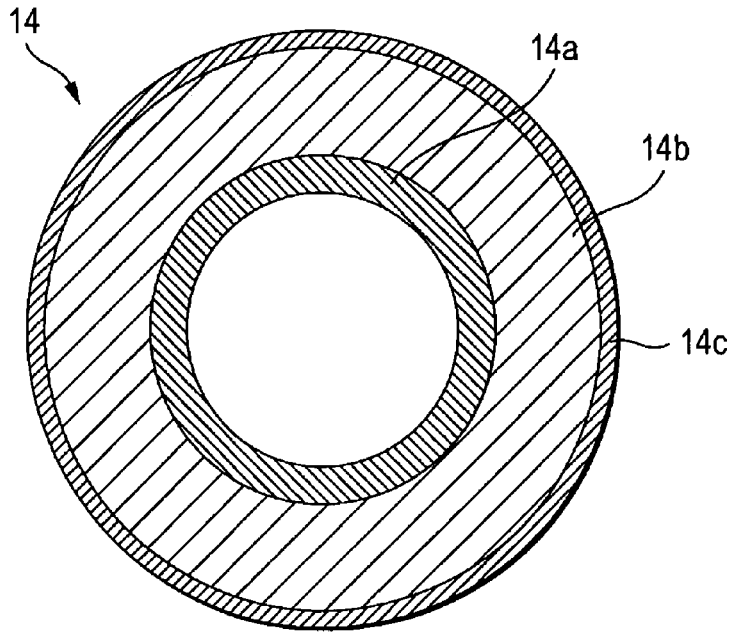
FIG. 3 is a schematic sectional view of a pressure roller of the fixing apparatus according to the embodiment.

FIG. 3 shows the structure of a pressure roller used in the fixing apparatus according to the embodiment.

Like the heat roller 13, the pressure roller 14 has a layered structure consisting of a core member, a rubber layer, and a fluororesin layer. Symbol 14*a* denotes a metal roller (aluminum roller) as a core member, 14*b* denotes a rubber layer provided on the core member 14*a*, and 14*c* denotes a fluororesin layer provided on the rubber layer 14*b*.

The rubber layer 14*b* of the pressure roller 14 is made thicker than the rubber layer 13*b* of the heat roller 13 and is formed on the core member 14 at a thickness of 4 to 8 mm. Such a thick rubber layer 14*b* makes it possible to obtain a sufficient nip width when it is brought into pressure contact with the heat roller 13.

Whereas the thermal conductivity enhancer is contained in the rubber layer 13*b* of the heat roller 13, a thermal conductivity enhancer need not always be contained in the rubber layer 14*b* of the pressure roller 14.

The fluororesin layer 14*c* is formed on the rubber layer 14*b* at a thickness of 80 to 300 μm.

The invention is not limited to the foregoing embodiment but may be embodied by a variety of modifications to the components without departing from the spirit and scope of the invention. By combining plural components disclosed in the foregoing embodiment as required, variations of the invention may be formed. For example, some of the components indicated in the embodiment may be deleted. Or, components related to different embodiments may be combined as required.

What is claimed is:

1. A fixing apparatus comprising:

a heat roller that comprises:

a heat source that generates heat to be supplied on a toner image formed on a recording medium;

a cylindrical core;

a rubber layer that is formed on the cylindrical core and comprises a thermal-conductivity-enhanced rubber, the rubber layer having a thickness of Tg that satisfies 200 μm ≦Tg≦600 μm and having a rubber hardness defined by JIS-A hardness of Hg that satisfies 40 degrees≦Hg≦80 degrees; and a fluororesin layer that is formed on the rubber layer, the fluororesin layer having a thickness of Tj that satisfies 80 μm≦Tj≦300 μm and 2 Tj≦Tg ≦10 Tj; and a pressure roller that presses the recording medium against the heat roller.

2. The fixing apparatus according to claim 1, wherein the heat roller has an outer diameter of 70 mm or more, and wherein the rubber layer has a thermal conductivity in a range of from 0.6 W/m×K to 1.5 W/m×K and a thermal conductivity variation of within 0.1 W/m×K.

3. The fixing apparatus according to claim 1, wherein the cylindrical core is formed in a hollow cylindrical shape, and wherein the heat source is disposed in a hollow space of the cylindrical core.

4. The fixing apparatus according to claim 3, wherein the cylindrical core has a thickness in a range of 4 mm to 8 mm.

5. The fixing apparatus according to claim 3, wherein the cylindrical core has a thickness in a range of 5 mm to 7 mm.

6. The fixing apparatus according to claim 1, wherein the thickness of the rubber layer Tg further satisfies 300 μm≦Tg≦500 μm.

7. The fixing apparatus according to claim 1, wherein the pressure roller has an outer diameter of 70 mm or more, and wherein the pressure roller comprises:

a second cylindrical core;

a second rubber layer that is formed on the second cylindrical core, the second rubber layer having a thickness in a range of 4 mm to 8 mm; and a second fluororesin layer that is formed on the second rubber layer, the second fluororesin layer having a thickness in a range of 80 μm to 300 μm.

8. The fixing apparatus according to claim 1, wherein the thermal-conductivity-enhanced rubber is made of a silicone rubber and a thermal conductivity enhancer, and wherein a ratio of parts by weight of the thermal conductivity enhancer to the silicone rubber is in a range of 1 to 5.

9. The fixing apparatus according to claim 8, wherein the thermal conductivity enhancer is made of alumina fine powder, silica, or metal silicon.

10. The fixing apparatus according to claim 1, wherein a thermal conductivity of the rubber layer is 2 to 4 times higher than a thermal conductivity of silicon rubber.

11. The fixing apparatus according to claim 1, wherein the pressure roller comprises:

a second cylindrical core; and a second rubber layer that is formed on the second cylindrical core, the second rubber layer having a thickness greater than the thickness of the rubber layer of the heat roller.

12. The fixing apparatus according to claim 1, wherein the heat roller has an outer diameter of 70 mm or more.

13. An image forming apparatus comprising:

an image forming unit that forms a toner image on a recording medium; and a fixing unit that fixes the toner image on the recording medium conveyed thereto, the fixing unit comprising:

a heat roller that comprises:

a heat source that generates heat to be supplied on the toner image formed on the recording medium;

a cylindrical core;

a rubber layer that is formed on the cylindrical core and comprises a thermal-conductivity-enhanced rubber, the rubber layer having a thickness of Tg that satisfies 200 μm≦Tg≦600 μm and having a rubber hardness defined by JIS-A hardness of Hg that satisfies 40 degrees≦Hg≦80 degrees; and a fluororesin layer that is formed on the rubber layer, the fluororesin layer having a thickness of Tj that satisfies 80 μm≦Tj≦300 μm and 2 Tj≦Tg≦10 Tj; and a pressure roller that presses the recording medium against the heat roller.

* * * * *